US006595091B2

(12) United States Patent
Williams

(10) Patent No.: US 6,595,091 B2
(45) Date of Patent: Jul. 22, 2003

(54) TOOL FOR GOLF SHOE SPIKES

(75) Inventor: Richard J. Williams, Strasburg, PA (US)

(73) Assignee: Quick Point, Inc., Fenton, MO (US)

( * ) Notice: Subject to any disclaimer, the term of this patent is extended or adjusted under 35 U.S.C. 154(b) by 0 days.

(21) Appl. No.: 09/874,667

(22) Filed: Jun. 5, 2001

(65) Prior Publication Data

US 2002/0178878 A1 Dec. 5, 2002

(51) Int. Cl.[7] ..... B25G 1/08

(52) U.S. Cl. ..... 81/490; 81/177.4; 81/176.15; 81/461

(58) Field of Search ..... 81/176.1, 176.15, 81/177.4, 461, 490

(56) References Cited

U.S. PATENT DOCUMENTS 673,056 A * 4/1901 Jacobs ..... 81/176.15
2,811,631 A * 10/1957 Wood ..... 81/177.4
5,052,253 A * 10/1991 Lin ..... 81/177.4
5,526,724 A * 6/1996 Bruggeman ..... 81/177.4
5,875,694 A * 3/1999 Graf ..... 81/176.15
5,887,496 A * 3/1999 Pollard et al. ..... 81/176.15

* cited by examiner

*Primary Examiner*—James G. Smith
(74) *Attorney, Agent, or Firm*—Polster, Lieder, Woodruff & Lucchesi, L.C.

(57) ABSTRACT

A tool for removing and installing a golf spike, having a threaded stud and a cleat at one end of the stud, includes a tubular body that surrounds a cavity, pins projecting from an end wall at one end of the body, and an end cap closing the other end of the body. The pins are spaced and otherwise configured to fit into holes that are in the cleat, so that when a torque is applied to the body, it will be transferred to the spike. The cavity contains several replacement spikes. The end cap snaps onto the body, yet has the capacity to rotate on the body.

7 Claims, 2 Drawing Sheets

TOOL FOR GOLF SHOE SPIKES

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to golf tools and, more particularly, to a tool for removing and installing spikes on golf shoes.

Traditionally, golfers wore shoes with metal spikes to improve their footing during drives and shots from fairways and the rough. But metal spikes seemed to damage the greens, and as a consequence many golf courses have banned them. Indeed, so-called soft spikes have all but replaced the traditional metal spikes. Soft spikes have threaded studs which engage threaded sockets in the soles of golf shoes and thus may be removed and replaced when the need arises. And this occurs with some frequency, because a soft spike presents a relatively soft plastic surface to the underlying turf or pavement over which a golfer walks.

Moreover, a golf shoe spike, whether it be soft or metal, has two small holes, which are offset from the axis of its threaded stud, to provide a location for engaging the spike and turning it, thus enabling one to remove or install the spike, provided a suitable tool is available. And tools having prongs designed to fit into the holes in the spikes exist, but they are usually flat and or otherwise are configured such that they are difficult to manipulate. Changing golf shoe spikes is a time-consuming procedure.

SUMMARY OF THE INVENTION

The present invention resides in a golf tool having a tubular body provided with an end wall from which axially directed projections extend, and they conform in location and thickness to the holes in a golf shoe spike, enabling the tool to be easily engaged with the spike. The tubular body is easily grasped and turned, and when turned, rotates a spike engaged with it. The body has a hollow interior which is large enough to hold several replacement spikes. The tool may include a cap that is attached to the body, although removable, and it closes the end of the cavity. The invention also resides in the tool engaged with a golf spike.

DETAILED DESCRIPTION

Figure 1:
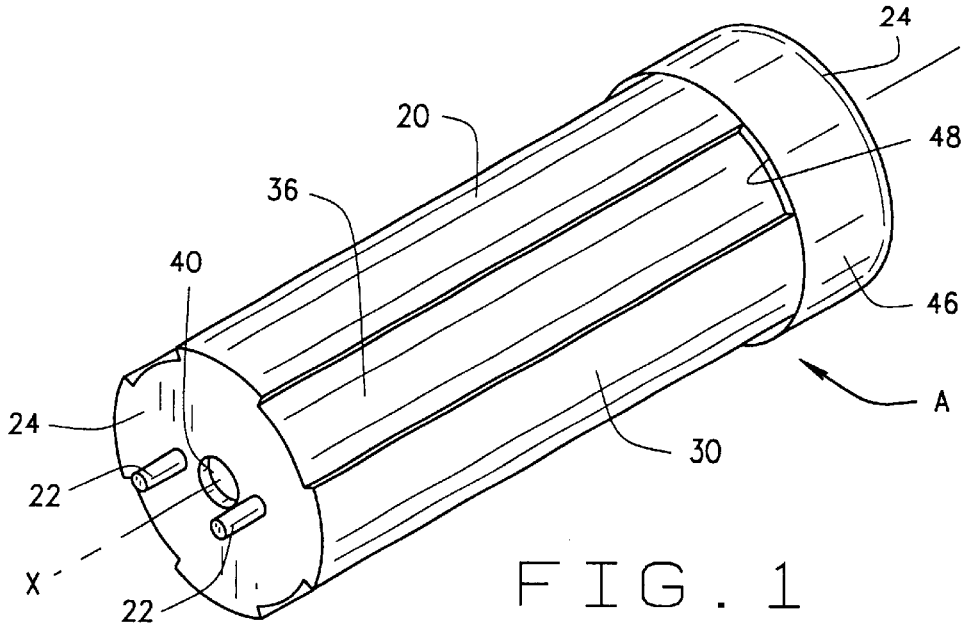
FIG. 1 is a perspective view of a golf tool constructed in accordance with and embodying the present invention.

Referring to the drawings, a tool A (FIG. 1) has the capacity to engage a golf spike B such that the spike may be rotated, either clockwise to install it in the sole of a golf shoe or counterclockwise to remove it. In addition, the tool A has the capacity to store enough spikes B to replace those that are first to wear on a pair of shoes.

The typical soft spike B may take any one of several forms. But irrespective of its form, it has (FIG. 2) a threaded stud 2 and a disk-like cleat 4 attached to one end of the stud, 2, with the stud 2 and cleat 4 being concentric about an axis Y which is the axis of the stud 2. Actually, the stud 2 projects from a back face 6 on the cleat 4 which also has a front face 8 that is presented away from the stud 2. The back face 6 is relatively flat or slightly concave, whereas the front face 8 has nibs 10 projecting from it. The cleat 4 also has two holes 12 opening out of its front face 8 on each side of the stud 2, with these holes 12 being spaced equidistantly from the axis Y of the stud 2 and located along a diameter of the cleat 4. In one version of spike B, the stud 2 is formed from metal and has a flange at one end. The cleat 4, on the other hand, is molded from plastic, with the flange of the stud 2 embedded within it. In this version the holes 12 pass through the metal flange on the stud 2. In another version, the stud 2 and cleat 4 are both molded from plastic as an integral unit.

The stud 2 of the spike B threads into a threaded socket in the sole of a golf shoe—indeed, far enough to bring the back face 6 of the cleat 4 snugly against the bottom surface of the sole. Thus, the cleat 4 lies below the sole where the nibs 10 are presented downwardly for gripping turf and providing a better footing for a golfer, particularly when executing drives and other shots.

The tool A includes (FIGS. 1 & 2) a tubular body 20, a pair of projections in the form of parallel pins 22 at one end of the body 20, and a rotatable end cap 24 at the other end where it provides a removable closure. The tool A is small enough to be easily grasped with one hand and easily fits into practically any pocket of a golf bag. Preferably the body 20 and cap 24 are molded from a polymer and are hard, whereas the pins 22 are formed from stainless steel.

Figure 4:
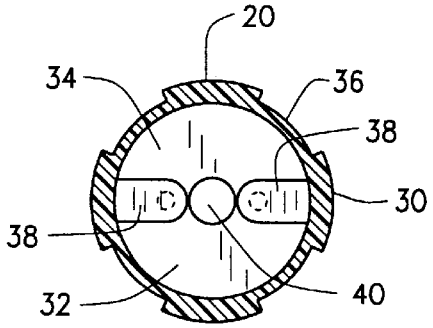
FIG. 4 is a sectional view of the tool taken along line 4—4 of FIG. 3.
Figure 5:
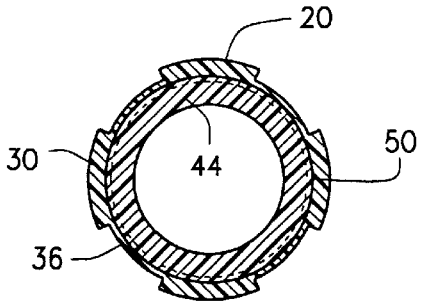
FIG. 5 is a sectional view of the tool taken along line 5—5 of FIG. 3.

The body 20 has a tubular side wall 30 of generally cylindrical configuration, and is thus symmetrical about a longitudinal axis X. It encloses a storage cavity 32 having a diameter that is greater than the diameter of the cleat 4 on a spike B. The body 20 also has an end wall 34 which is formed integral with the side wall 30 at one end of the side wall 30 and thus closes one end of the cavity 32. The diameter and length of the body 20 are such that the body 20 is easily grasped with a single hand. To facilitate gripping, the side wall 30 of the body 20 has flutes 36. The end wall 32, on the other hand, on its exterior surface, is flat and squared off with respect to the axis X of the cylindrical body 20. Within the cavity 32, the end wall has (FIG. 4) two radially directed ribs 38 which extend inwardly from the side wall 34, yet are separated at the axis X of the body 20. Here the end wall 34 contains an aperture 40 which opens into the space that separates the two ribs 38. Near its opposite end, which is open, the side wall 30 contains (FIGS. 3 & 5) an annular groove 42 which opens inwardly into the cavity 32.

Figure 3:
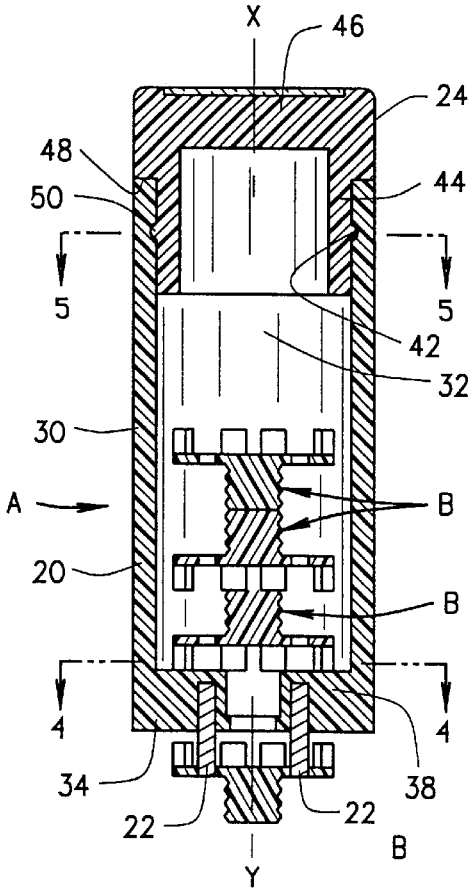
FIG. 3 is a longitudinal sectional view of the golf tool containing replacement spikes in its hollow interior and engaged with a spike at its exterior.
Figures 2, 6:
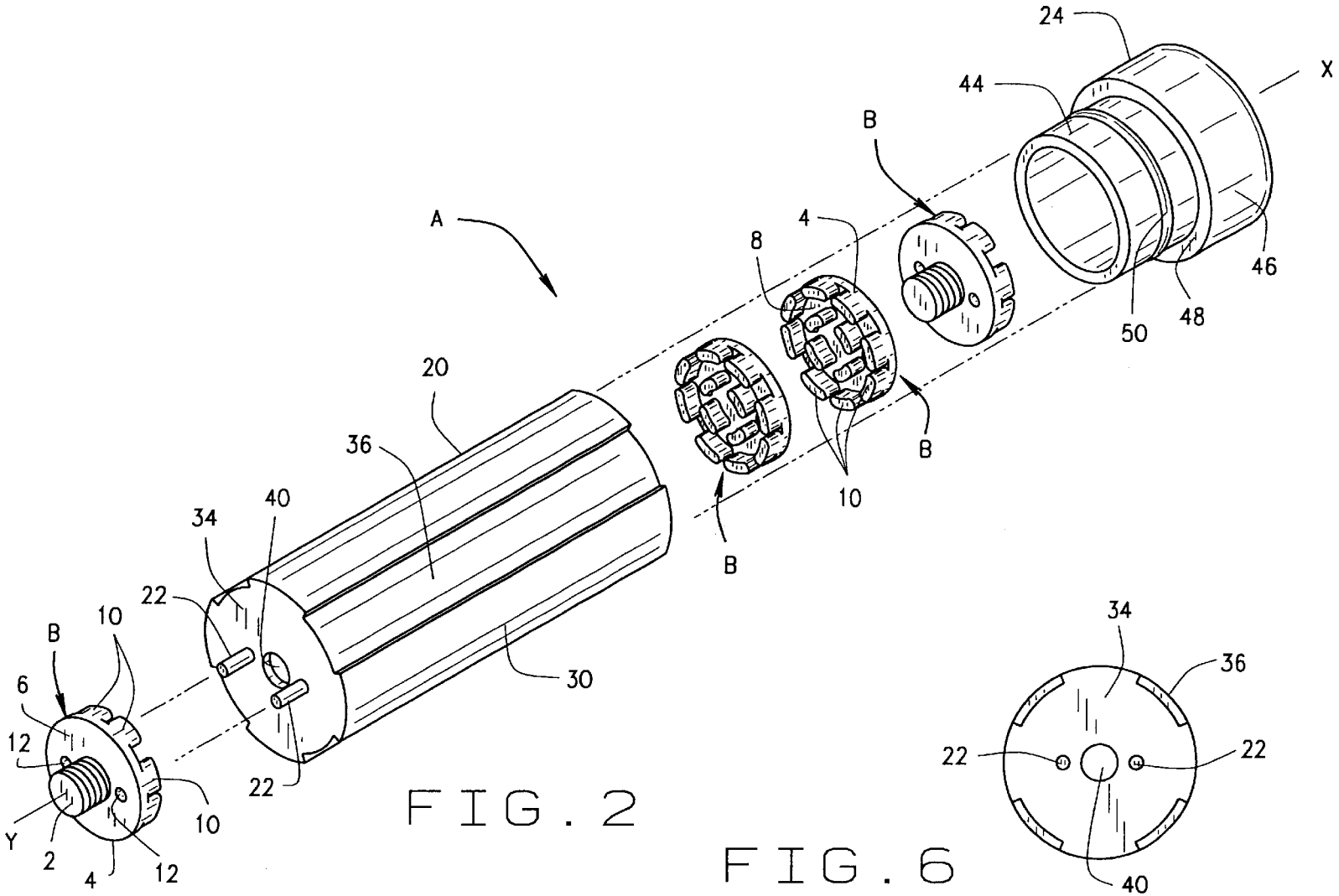
FIG. 2 is an exploded perspective view of the golf tool along with several golf spikes.
FIG. 6 is an end view of the tool.

The pins 22 project from the end wall 34 where they lie parallel to each other and to the axis X of the body 30 (FIGS. 1–3). Indeed, they are embedded in the end wall 34 at the ribs 38, each one extending into a separate rib 38. The pins 22 have a diameter slightly smaller than the diameter of the holes 12 in the cleats 4 of the spikes B. Moreover, the spacing between the pins 22 corresponds to the spacing between the holes 12. Finally, the pins 22 are spaced equidistantly from the axis X and the aperture 40 that is along the axis X.

The end cap 24 has (FIGS. 2 & 3) a cylindrical core 44 and an enlarged head 46 at one end of the core 44, with the core 44 and head 46 merging at a shoulder 48. The outside diameter of the core 44 is slightly smaller than the diameter of the cavity 32 in the body 20, so that the core 44 slides easily into the cavity 32—at least initially. In this regard, the core 44 on its cylindrical exterior surface has an annular rib 50, the diameter of which is slightly greater than the diameter of the cavity 32, but not so great that it cannot be advanced with moderate force along the surface of the cavity 32. Moreover, the rib 50 is slightly smaller than the annular groove 42 in the side wall 30 of the body 20, and the spacing between it and the shoulder 48 corresponds to the spacing between the groove 48 and the open end of the side wall 30. Thus, as the rib 50 advances along the surface of the cavity 32, it will encounter the groove 42 when the shoulder 48 approaches the end of the side wall 30. Indeed, the rib 50 will snap into the groove 42 and retain the end cap 24 on the body 20. Nevertheless, the engagement of the rib 50 with the groove 42 is such that it does not impede rotation of the cap 24 relative to the body 20. The cap 24 spins easily on the body 20.

The enlarged head 46 projects beyond core 44 and closes the hollow interior of the core 44 as well as the end of the cavity 32 in the body 20. The diameter of the head 46 corresponds to that of the side wall 30 on the body 20, thus leaving small areas of the shoulder 48 exposed at the ends of the flutes 36 (FIG. 1), so that the head 46 may be grasped within several of the flutes 36 and pulled away from the body 30. A moderate amount of force applied in this manner will release the annular rib 50 from the groove 42 and permit withdrawal of the cap 24 from the body 30, thus exposing the open end of the cavity 32.

The cavity 32 contains enough spikes B to replace those that are most likely to wear down first on a pair of golf shoes. To replace a worn spike B, the user aligns the pins 22 at the end wall 34 of the body 20 with the holes 12 in the cleat 4 of the worn spike B (FIG. 2) and inserts the pins 22 into those holes 12 (FIG. 3). The user, gripping the body 20 with fingers and thumb of one hand in the flutes 36 of the body 20 and the palm of that hand against the head 46 of the end cap 24, rotates the body 20 counterclockwise. The torque applied is transferred to the spike B which rotates. Indeed, the user rotates the body 20 through enough rotations to back the threaded stud 2 of the spike B completely out of its threaded socket in the sole of the golf shoe. While the body 20 rotates, the end cap 24 remains stationary against the user's palm, owing to its capacity to rotate easily on the body 20. The user removes the worn spike B from the pins 22 and discards it.

Thereupon, the user withdraws the end cap 24 from the body 20 simply by gripping the head 46 of the cap 24 from within several of the flutes 36 and pulling it away from the body 20 with enough force to dislodge the annular rib 50 from the annular groove 42 in the body 20. The rib 50 slides over the remaining surface of the cavity 32 and reaches the end of that surface, whereupon the cap 24 will lift freely from the body 20. With the cap 24 removed, the end of the cavity 32 is exposed, and a new spike B is retrieved from the cavity 32.

The threaded stud 2 on the new spike B is engaged with the threaded socket in the shoe sole and rotated a turn or two. Then, with the end cap 24 replaced on the body 20 to close the end of the cavity 32, the pins 22 on the tool A are engaged with the holes 12 in new spike B, and the body 20 is rotated clockwise enough turns to bring the back face 6 of the cleat 4 snugly against the sole of the shoe. Again the end cap 24 remains stationary against the palm of the user's hand while the body 20 rotates on it under a torque applied through the fingers and thumb of that hand.

The tool A may also remove or install metal spikes. Each metal spike has a cleat in the form of a single conical projection directed away from, but axially aligned with, the threaded stud of the spike and a flange between the projection and stud. The flange contains two holes which align with and receive the pins 22 on the end wall 34 of the tool A. The aperture 40 in the end wall 34 accommodates the conical projection when the pins 22 are received in the holes of the flange.

QUICK POINT PARTS LIST

A tool
B golf spike
X axis of tool body
Y axis of spike
2 threaded stud
4 cleat
6 back face
8 front face
10 nibs
12 holes
20 body
22 pins
24 end cap
30 side wall
32 storage cavity
34 end wall
36 flutes
38 ribs
40 aperture
42 annular groove
44 core
46 head
48 shoulder
50 annular rib

What is claimed is:

1. A golf tool for removing and installing a golf spike having a threaded stud and a cleat at one end of the stud, with the cleat having holes offset from the axis of the stud, said tool comprising: a tubular body containing a cavity that is configured to hold several spikes, the body being molded from a polymer and including a side wall which encloses the cavity and an end wall attached to one end of the side wall, the end wall including ribs which are exposed to the cavity where they extend out to the side wall; projections at one end of the body and being configured and spaced to fit into the holes of the spike, the projections being metal pins which extend into the ribs of the end wall and are embedded in the end wall including its ribs, and project from the end wall; and a closure at the other end of the body where it closes an end of the cavity.

2. A golf tool according to claim 1 wherein the closure is an end cap which is fitted to the side wall such that it can be released from the side wall to expose the cavity.

3. A golf tool according to claim 2 wherein the cap rotates freely on the end of the side wall when it is attached to the side wall.

4. A golf tool according to claim 3 wherein the side wall contains an annular groove which opens into the cavity and closes upon itself; and wherein the end cap includes a core which fits into the end of the cavity from said other end of the body and contains a rib which is received in the groove when the cap is attached to the side wall of the body.

5. A golf tool according to claim 3 wherein the end cap includes a core which fits into the cavity of the body and a head which projects laterally beyond the core to form a shoulder at the end of the core; and wherein a portion of the shoulder is exposed to facilitate gripping the head of the cap and withdrawing the cap from the body.

6. A golf tool according to claim 5 wherein the body contains flutes which open outwardly away from the cavity and the shoulder on the cap is exposed at the ends of the flutes.

7. A golf tool according to claim 1 and further comprising at least one golf spike located in the cavity of the body.

* * * * *